United States Patent [19]

Bar

[11] 4,415,060

[45] Nov. 15, 1983

[54] MUFFLER FOR COMPRESSORS

[75] Inventor: Alfredo Bar, Pavia, Italy

[73] Assignee: Necchi, S.p.A., Pavia, Italy

[21] Appl. No.: 349,474

[22] Filed: Feb. 17, 1982

[30] Foreign Application Priority Data

Feb. 24, 1981 [IT] Italy ..... 42905 A/81

[51] Int. Cl.[3] ..... F01N 1/08; F25D 19/00

[52] U.S. Cl. ..... 181/272; 181/403; 417/312; 62/296

[58] Field of Search ..... 181/240, 272, 403; 62/296; 417/312

[56] References Cited

U.S. PATENT DOCUMENTS 4,111,278 9/1978 Bergman ..... 181/403 X

*Primary Examiner*—Benjamin R. Fuller

*Attorney, Agent, or Firm*—Stevens, Davis, Miller & Mosher

[57] ABSTRACT

A muffler for hermetically sealed compressors consisting of a body made of plastic material with two chambers separated by a wall and directly assembled on the compressor cylinder head by means of two lined up small tubes equipped with special sealing means. The danger that the muffler may break loose from the head and possibly rotate on its axis of vertical symmetry is thus avoided.

1 Claim, 2 Drawing Figures

MUFFLER FOR COMPRESSORS

DISCLOSURE OF THE INVENTION

This invention relates to a muffler for a compressor which compressor consists of an operating electric motor, a cylinder, and a head for the cylinder in which are located the intake and compression chambers for the refrigerant gas.

As usual, the mufflers, one on the intake tube and the other on the delivery tube, are located in the body of the compressor.

Compressors are known also in which the mufflers are within the cylinder head. In both cases the cost of the construction of the muffler devices was in fact rather expensive and the cost was material to the total cost of the compressor.

An object of the present invention is to provide a muffler on the intake tube, i.e. a muffler device which is both simple and inexpensive to manufacture.

The technical problem to be solved was to find a new conformation for the muffler, an appropriate construction material and a new connection system between it and the intake chamber.

The solution of the technical problem is characterized by the fact that the muffler is made of plastic material resistant to chemical agents of the refrigerant gas and the lubrication oil and that it consists of two chambers separated by a central wall, the first of which will be provided with a hole for the passage of the refrigerant gas, whereas the second chamber will be connected, through a hole and a small tube, with the intake chamber existing in the cylinder head.

Other details and features of the invention will stand out from the description given below by way of non-limitative example and with reference to the accompanying drawings, in which.

Figure 1:
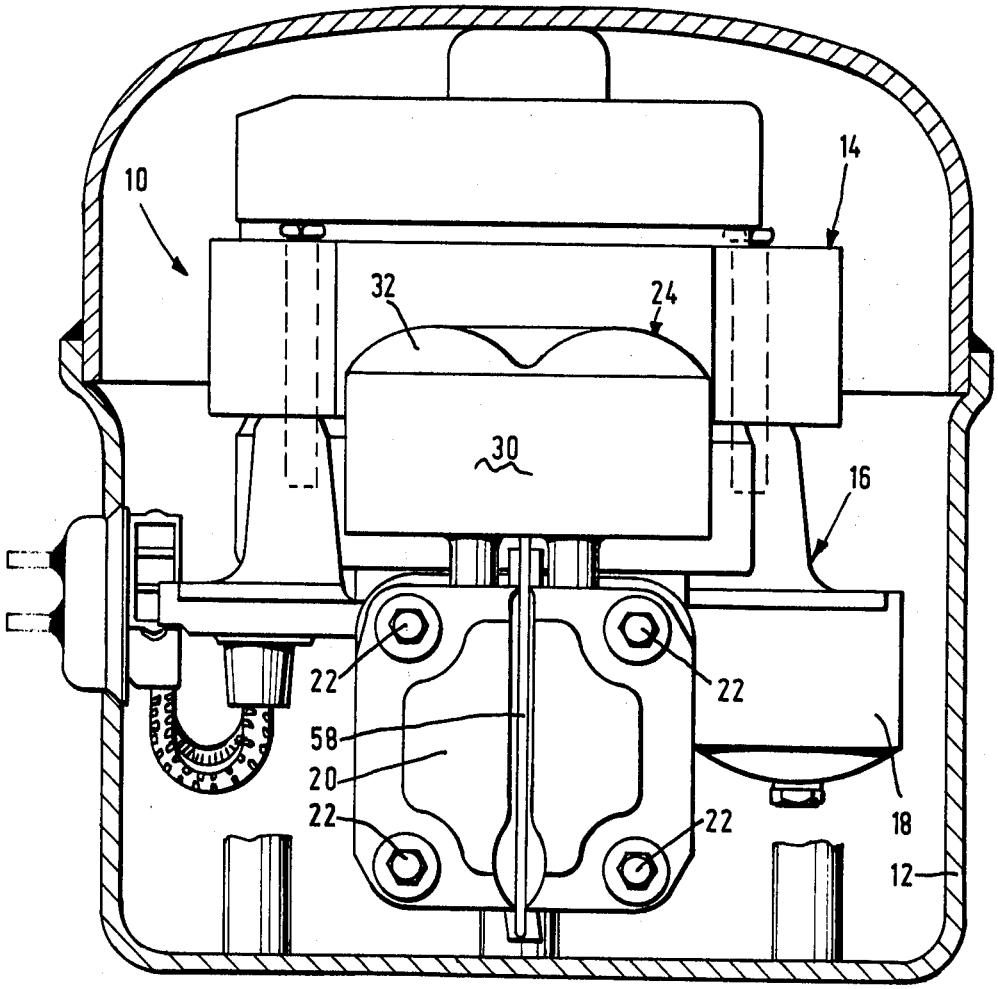
FIG. 1 shows a general view of a compressor.

With reference to FIG. 1, the compressor unit 10 is included in a hermetically sealed shell 12, which contains the refrigerant gas. Compressor 10 consists of an electric motor 14, a body 16, and a muffler 18 on the delivery tube provided in the body 16 when the piece is molded.

Head 20 is connected by means of nuts 22 with the cylinder not shown in the Figure.

Muffler 24 is connected above the head, in a way which will be described in detail later on.

Figure 2:
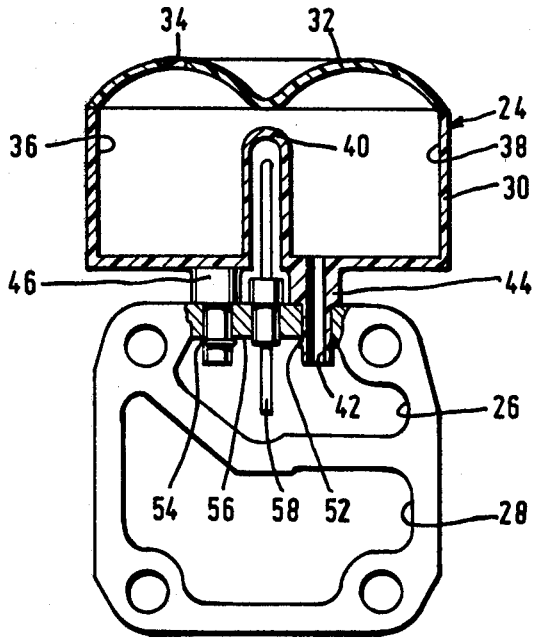
FIG. 2 shows a cutaway view of the muffler group and the compressor cylinder head of FIG. 1.

FIG. 2 shows in detail the conformation of the muffler and its connection system with intake chamber 26 provided in the head 20 together with the compression chamber 28. The muffler 24 is constructed from plastic material resistant to the chemical agents of the refrigerant gas and consists of a body 30 and a cap 32, which closes the body 30 from above. In its upper wall, cap 32 has a hole 34 through which the refrigerant gas is sucked from shell 12. In connection with hole 34, in muffler 24 there is a first chamber 36 in which the refrigerant gas expands. A second chamber 38 is kept apart from the first chamber by a wall 40, on top of which there is a narrow passage for the refrigerant gas.

A hole 42, existing in the bottom wall of chamber 38, is connected with intake chamber 26 through a small tube 44 on the body 30. A second small tube 46 connects muffler 24 with head 20, which tube is located on the bottom wall of the first chamber 36 without, however, directly communicating with it. The lower ends of small tubes 44 and 46 are forced into corresponding holes on the upper part of the head 20. The use of these two small tubes prevents the muffler from rotating on the axis of vertical symmetry owing to the vibrations of the compressor, whereas the possible slipping off of this from the head is avoided by rings 52 and 54 applied on the small tubes 44,46 at such a height that when the muffler is in operation they abut against wall 56 of head 20.

Due to the elasticity of the material with which the muffler has been constructed, the rings are deformed during their assembly thus permitting the connection between the muffler and head whereas in the operating position they block the organs and ensure the seal of the connection so as to avoid any leakage of refrigerant oil.

FIGS. 1 and 2 show a small capillary tube 58 which according to an already known technique sends small quantities of lubricant drawn from the shell to the valve system existing in the head and not shown in the figures.

What is Claimed:

1. A muffler for compressors which compressors consist of an electric motor, a cylinder and a head for the cylinder in which are located the intake and compression chambers for refrigerant gas, comprising a muffler body constructed from plastic material resistant to the action of the chemical agents of the refrigerant gas and the lubricating oil and which consists of first and second chambers separated partially by a central wall, said muffler body having a hole therein communicating with said first chamber for the passage of said refrigerant gas and an external small tube extending therefrom through which said second chamber communicates with the intake chamber located in said head, a second small tube extending from the muffler body below said first chamber and co-operating with said small tube interconnecting the second chamber and the intake chamber of said head, said head having two holes communicating with said intake chamber for receiving and projecting both small tubes into said intake chamber, and two rings one on each tube which hold the muffler body to the head.

* * * * *